US007857249B2

(12) United States Patent
Nanney et al.

(10) Patent No.: US 7,857,249 B2
(45) Date of Patent: Dec. 28, 2010

(54) TIRE CHOPPING APPARATUS AND METHOD

(76) Inventors: Douglas T. Nanney, 1990 Cameron Rd., Berlin Township, MI (US) 48002; Claudia J. Nanney, 1990 Cameron Rd., Berlin Township, MI (US) 48002; Keith N. Goodreau, 924 B, Blacks Corners Rd., Imlay City, MI (US) 48444; Karen K. Goodreau, 924 N. Blacks Corners Rd., Imlay City, MI (US) 48444

( * ) Notice: Subject to any disclaimer, the term of this patent is extended or adjusted under 35 U.S.C. 154(b) by 186 days.

(21) Appl. No.: 12/177,966

(22) Filed: Jul. 23, 2008

(65) Prior Publication Data

US 2009/0025519 A1 Jan. 29, 2009

Related U.S. Application Data

(60) Provisional application No. 60/961,705, filed on Jul. 24, 2007.

(51) Int. Cl.
*B02C 19/00* (2006.01)

(52) U.S. Cl. ..... 241/271; 241/283; 241/DIG. 31

(58) Field of Classification Search ..... 241/DIG. 31, 241/100, 283, 270, 271; 83/951, 687, 691
See application file for complete search history.

(56) References Cited

U.S. PATENT DOCUMENTS

| | | | | |
|---|---|---|---|---|
| 5,443,567 | A * | 8/1995 | Pruett | 241/29 |
| 5,482,215 | A * | 1/1996 | Veres | 241/1 |
| 5,551,325 | A | 9/1996 | Schutt | |
| 5,590,838 | A * | 1/1997 | Brewer | 241/23 |
| 5,601,240 | A * | 2/1997 | Merklinger et al. | 241/101.74 |

* cited by examiner

*Primary Examiner*—Faye Francis
(74) *Attorney, Agent, or Firm*—John R. Benefiel

(57) ABSTRACT

Used tires are chopped up in a punch press which progressively punches out areas of each tire lying flat in the press. The tire fragments are conveyed from the press to a collection container. An elevator mechanism may receive four tires stacked vertically, each used tire therein successively fed into the press by a feed mechanism receiving each tire from the elevator mechanism. An on-site enclosure houses all of the components and a container of collected fragments which is accessed for removal through a door in the enclosure.

11 Claims, 8 Drawing Sheets

TIRE CHOPPING APPARATUS AND METHOD

CROSS REFERENCE TO RELATED APPLICATIONS

This application claims the benefit of U.S. provisional application No. 60/961,705 filed on Jul. 24, 2007.

BACKGROUND OF THE INVENTION

This invention concerns recycling of used tires and more particularly the chopping up of tires in order to facilitate recycling of the tires by reducing their bulk Also, chopped up tire materials are easier to handle than the tires themselves.

It has been the practice of retailers selling new tires to ship old tires to be scrapped to recycling facilities, but this entails the high costs of shipping and handling of the used tires by the tire retailers which significantly adds to their cost of doing business.

In U.S. Pat. No. 5,551,325 it is proposed to provide an onsite tire chopping apparatus using cutters or alternatively a set of punches to punch out successive radial sections of each tire. However, the machine described therein requires indexing each tire about its center and cutting up of the outer perimeter into relatively large pieces, leaving the tire bead as a bulky separate item for disposal.

In addition, the indexing process to bring each tire section beneath the punch set makes the process relatively slow. Also, the machine and necessary collection containers take up valuable space within the retailer's facility. The pick up of the tire fragments typically will require storage within the facility and the necessity for further handling incidental to pick up of the stored material is an added burden.

It is an object of the present invention to provide a more rapid and complete chopping up of used tires.

It is another object to provide a tire chopping installation which is not required to be located within an existing building at the site where the tires are processed but where chopped up tire fragments can be conveniently stored and accessed for removal.

SUMMARY OF INVENTION

The above recited objects and other objects which will be understood upon a reading of the following specification and claims are achieved by an apparatus incorporating a punch array preferably formed by a staggered two or more rows of punches and dies of a length able to completely span the major diameter of the tires to be cut up. Each tire may be incrementally advanced lying flat between the punch and die set array and a high tonnage press used to punch up a tire strip section extending completely across the tire diameter to speed up the process by chopping up larger sections than prior art machines. Each tire is fed into the press laying flat on its sidewall, completely received between the punch-die rows, the punches advanced normally to the main plane of the tire to completely cut up the tire section by section including the tire bead.

The apparatus and a collection container is completely contained within an enclosure having an opening door for receiving the used tires which a loaded into an elevator-lift mechanism located adjacent the press and a transfer mechanism is adapted to successively advance each of four tires off the elevator and into the cutting press.

A conveyor receives the cut up tire fragments and transfers the same into a collection container, the conveyor and container also sheltered within the enclosure so as to be able to be located outside the facility buildings if desired. One or more access doors to allow removal of the collection container and for maintenance of the apparatus are provided in the enclosure external walls.

The enclosure may be constructed from a standard shipping containers.

DETAILED DESCRIPTION

Figure 1:
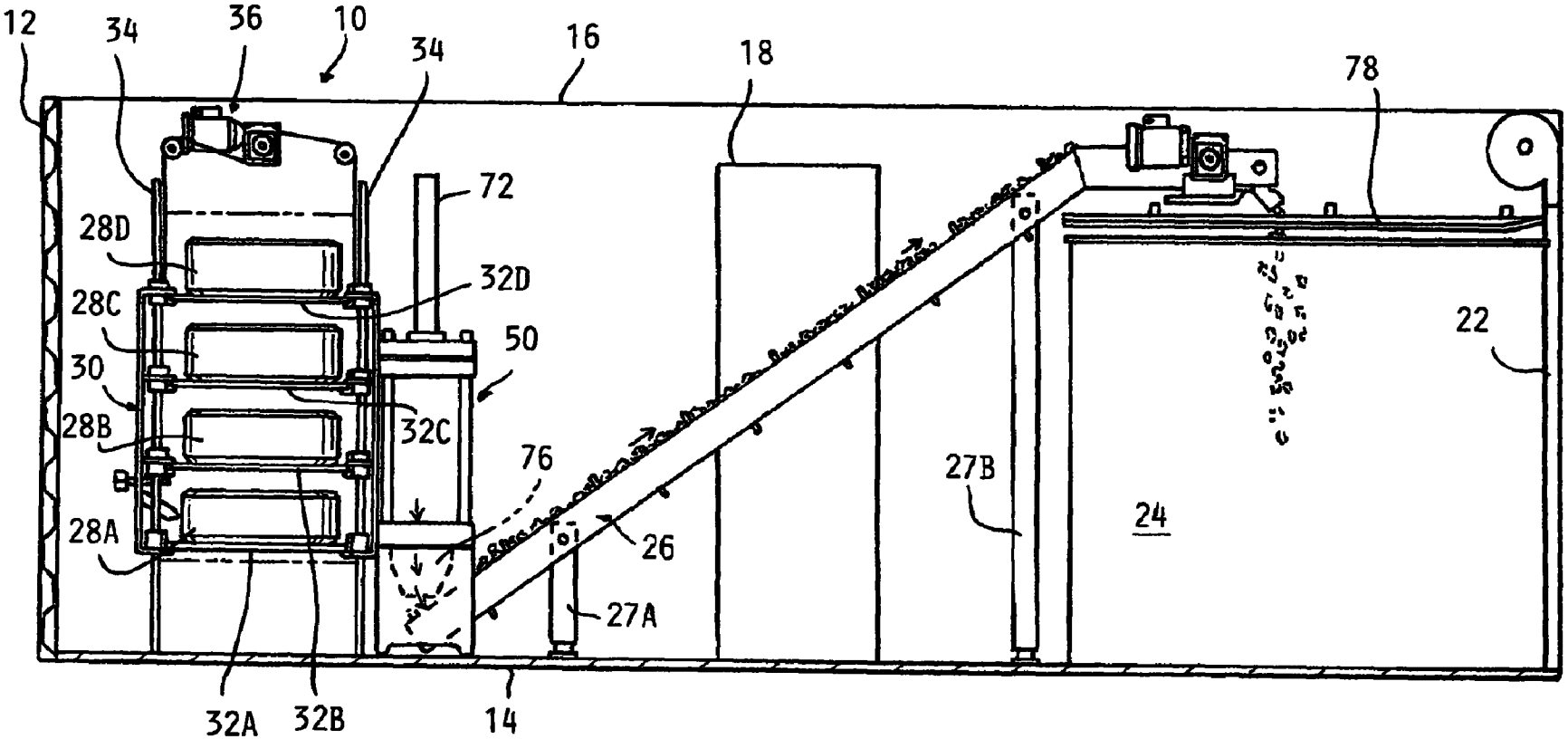
FIG. 1 is a side elevational sectional view of an enclosure with a tire chopping apparatus a conveyor and collection container also disposed therein.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, an enclosure 10 is sized to house components of the tire chopping apparatus, i.e., approximately 20 feet long and eight feet wide constructed with corrugated metal sides 12, a wooden floor 14 and metal roof 16. The enclosure 10 can advantageously be constructed from a standard shipping container.

A maintenance access door 18 is shown on one side and a roll up tire loading door 20 on the other, although the particular arrangement of doors shown is optional. A roll-up unloading door 22 at one end of the enclosure 10 allows access for ready removal of a collection container 24, into which are received chopped up tire fragments transported thereto as by a flight conveyor 26.

A set of four tires 28A, B, C, D are able to be loaded lying flat into an elevator mechanism 30 having a vertically stacked series of four platforms 32A, 32B, 32C, 32D, each platform able to hold a respective tire 28A-28D.

Figure 4:
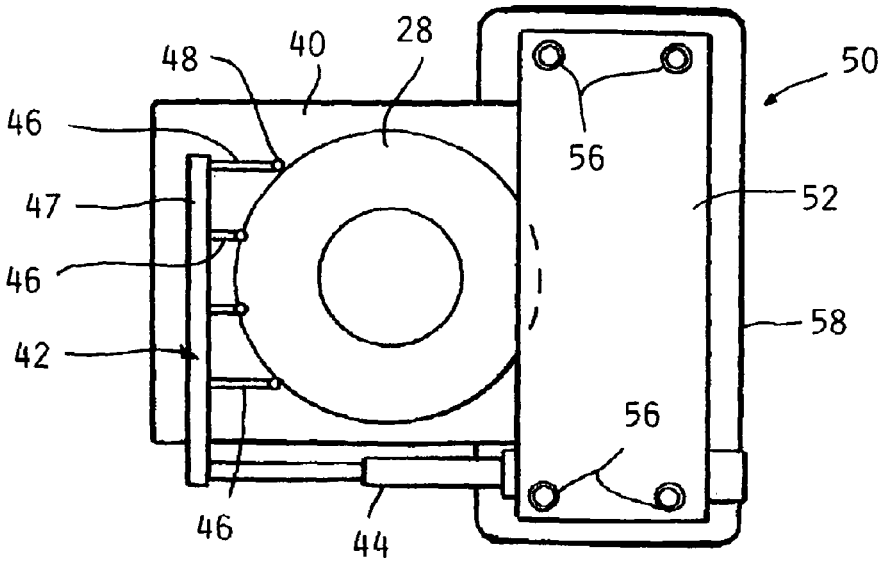
FIG. 4 is a plan view of the tire chopping apparatus shown in FIG. 3.

A tire transfer device 38 (FIGS. 12-16) enables movement of each tire 28A-28D successively out of the elevator mechanism 30 and onto a press loading platform 40. A feed member 42 is located at the loading platform 40 which may be connected to a power cylinder 42 (FIG. 4) to be stroked so as to incrementally advance the feed member 42. Actuation of the power cylinder 44 causes advancement of the feed member 42 to cause a series of rods 48 on bars 46 attached to a mounting member 52 to contact the perimeter of each tire 28. Further advance causes each tire 28 to be incrementally advanced linearly while lying flat on its side step by step into a punch press 50 located alongside the press loading platform 40.

Figure 3:
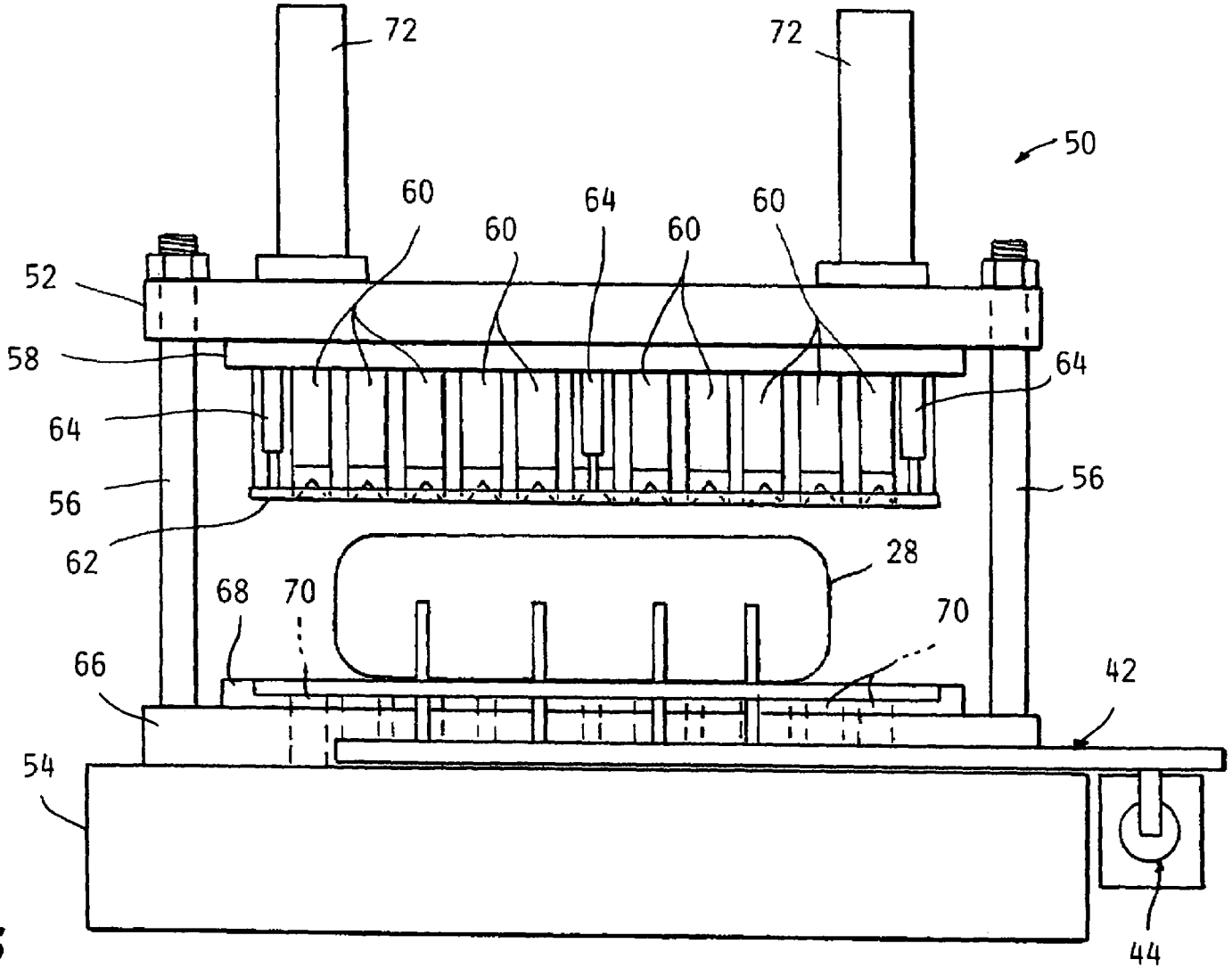
FIG. 3 is an enlarged side elevational view of the tire chopping apparatus shown in FIGS. 1 and 2.

The punch press 50 includes an upper platen member 52 and a base lower member 54 spaced apart on posts 56 (FIG. 3).

Figure 5:
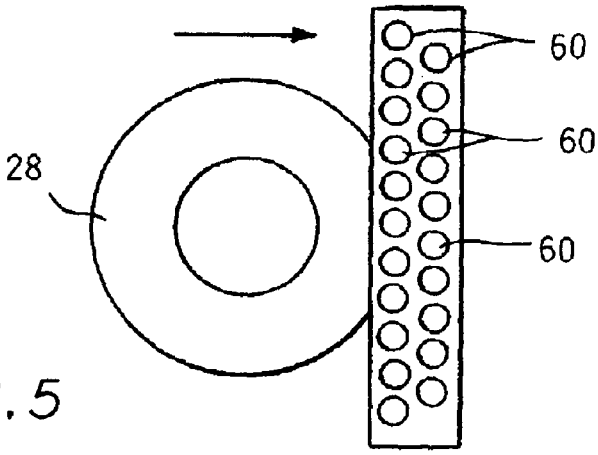
FIG. 5 is a diagrammatic plan view of a tire being fed flat beneath a punch array included in the tire chopping apparatus shown in FIGS. 3 and 4.

An upper die shoe 58 mounts an array of closely spaced punches 60 arranged in two offset rows (FIG. 5) of a length sufficient to completely span the major diameter of the tires 28.

A stripper plate 62 is mounted to gas springs 64, the punches 60 passing through holes in the stripper plate 64 to be able to be stripped out of the tires 28 after each punching stroke, in the well known manner.

A lower die shoe 66 mounts a lower die set 68 having dies 70 matched to the punches 60.

Figure 6:
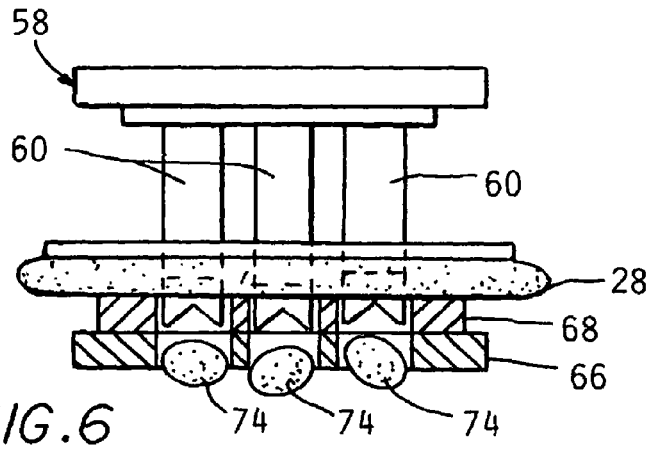
FIG. 6 is a side elevational view of a tire being punched into fragments with the punch array shown in FIG. 5.
Figure 7:
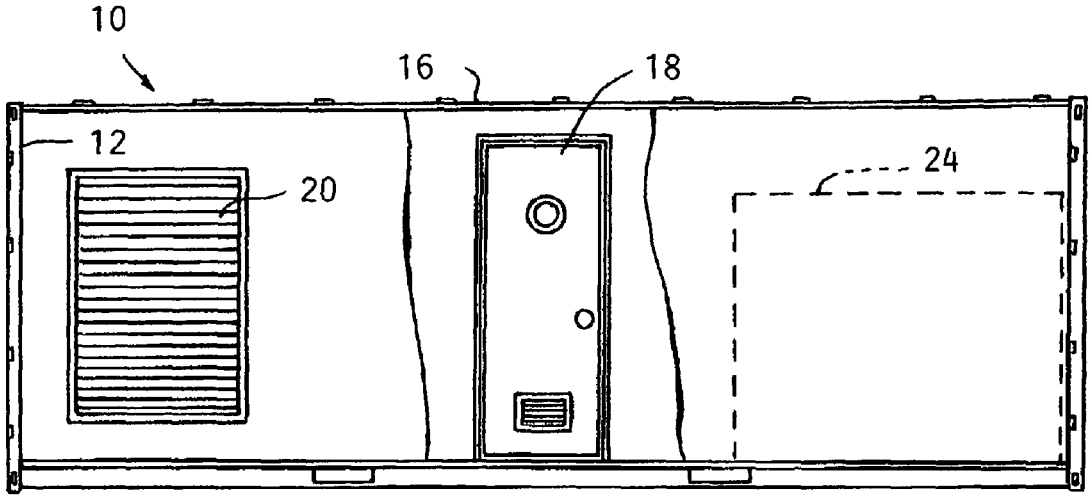
FIG. 7 is an external side elevational view of the enclosure shown in FIG. 1 partially broken away.
Figure 8A:
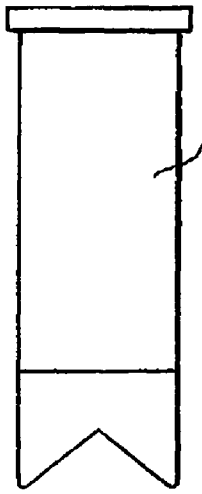
FIGS. 8A, 9A, 10A are side elevational views of different punch shapes.
Figure 9A:
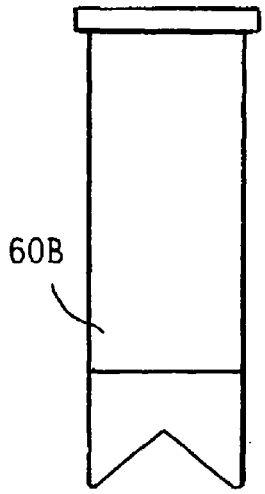
Figure 10A:
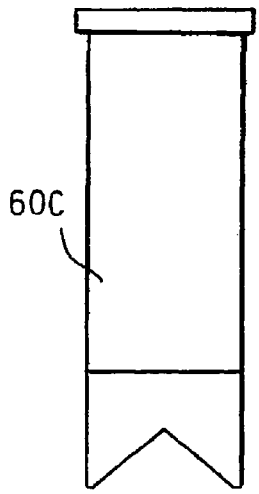
Figure 8B:
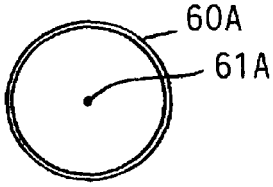
FIGS. 8B, 9B, 10B are end views of the punches shown in FIG. 8A, 9A, 10A respectively.
Figure 9B:
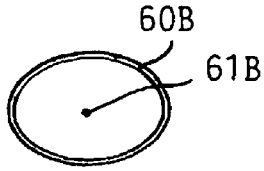
Figure 10B:
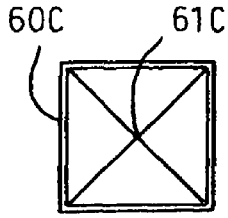
Figure 11:
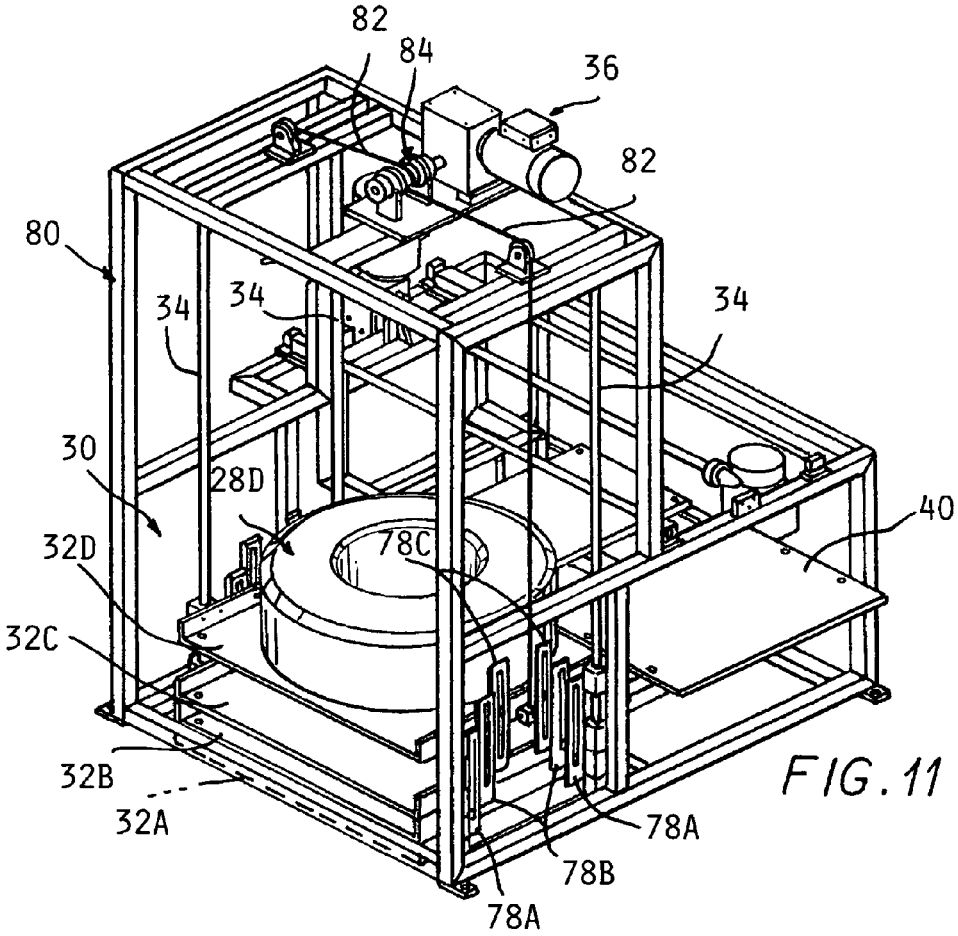
FIG. 11 is a pictorial view of the tire chopping apparatus shown in FIGS. 1 and 2 with a single tire in the elevator mechanism.
Figure 12:
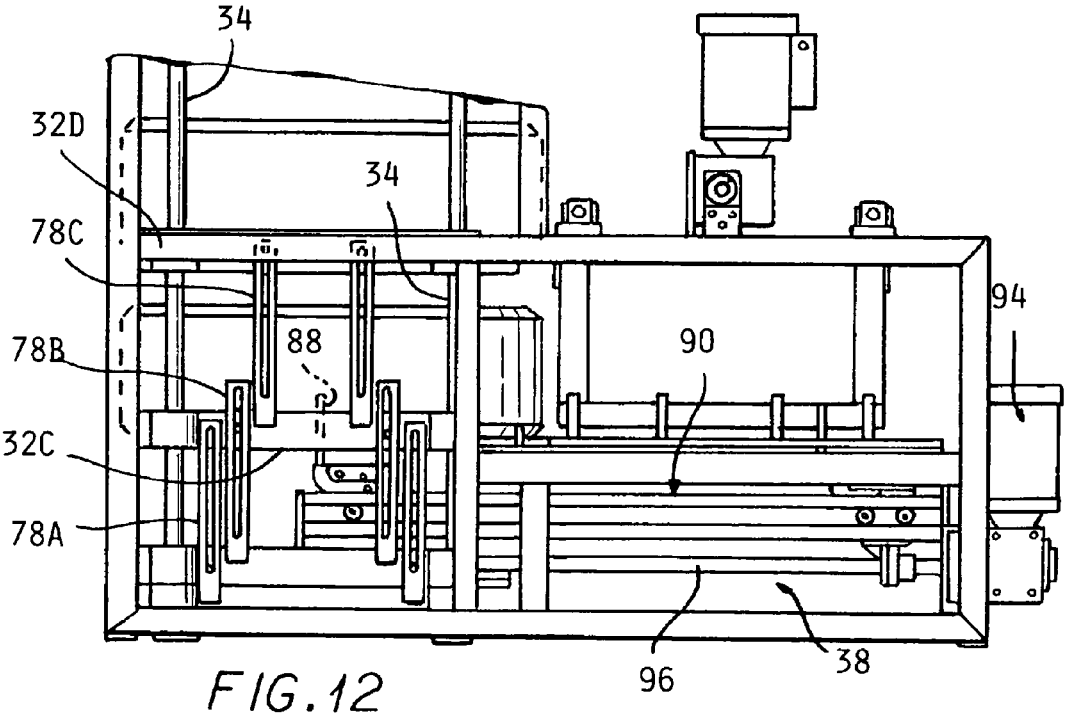
FIG. 12 is a fragmentary right side view of the tire chopping apparatus shown in FIG. 11 with two tires in the elevator mechanism.

A pair of hydraulic cylinders 72 (FIG. 3) enable actuation of the upper die shoe 58 to advance the punches 60 so as to penetrate successive sections extending completely across a tire 28 fed lying flat into the press punching out a pattern of holes therein, generating slugs 74 of tire material (FIG. 6).

As noted, the offset rows of punches 60 extend completely across the major diameter of the tires 28 and as the tires 28 are each incrementally advanced into the press 50, all portions of the tire including the bead and tread are subjected to the punching operation to completely chop up all portions of the tires into slugs 74 and punched out fragments (not shown) of each tire 28.

These fragments drop below into a guide chute 76 which directs them into a flight conveyor 26 mounted to be upwardly inclined on supports 27A, 27B (FIG. 1). Operation of the flight conveyor 26 continuously transports the chopped up tire fragments upwardly to a location above the collection container 24 where they are discharged from the upper end of the conveyor 26 falling into the collection container 24.

Figure 2:
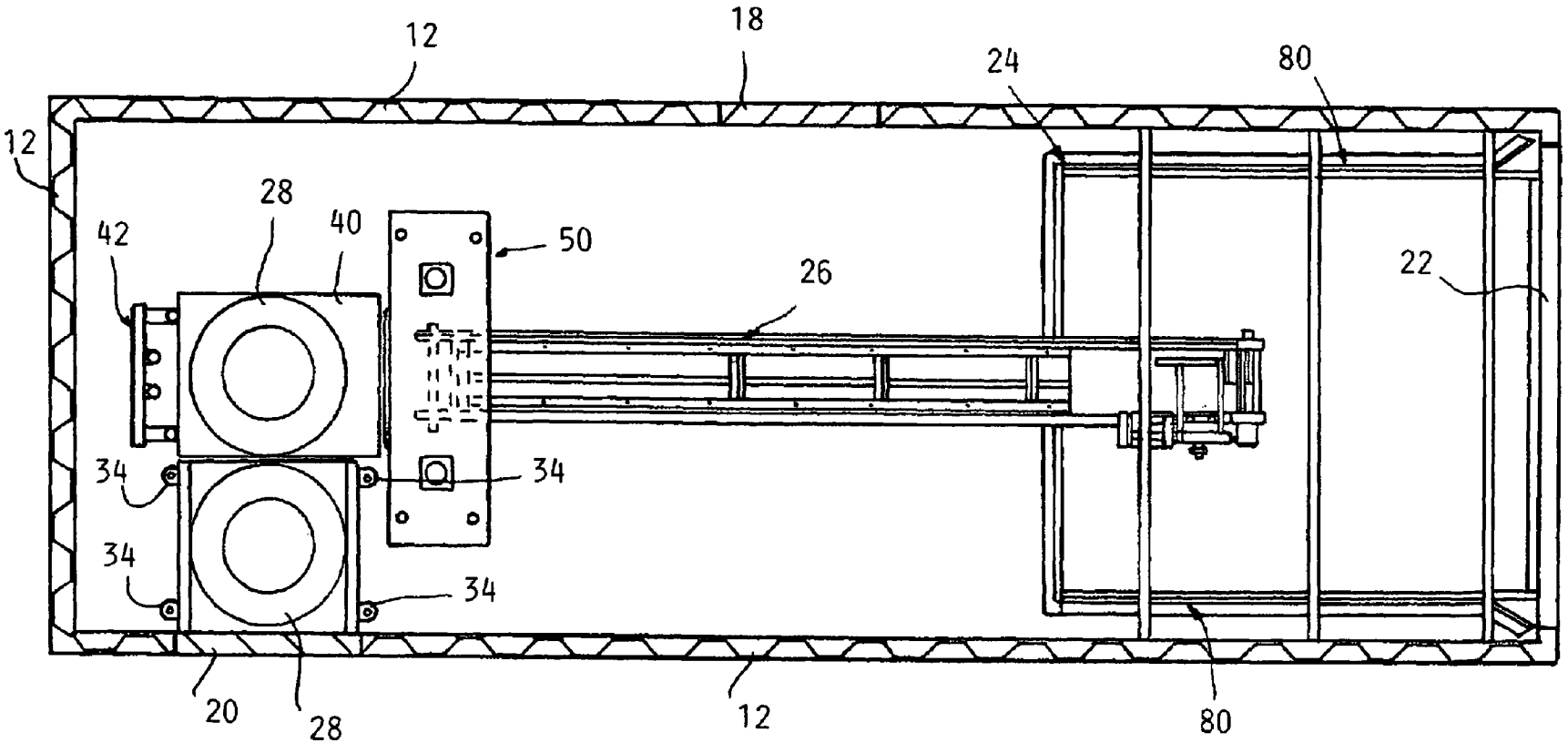
FIG. 2 is a plan sectional view of the enclosure and a plan view of the components therein shown in FIG. 1.

The collection container 24 is disposed within upper guides 78 (FIG. 1) and floor mounted guides 80 (FIG. 2) to be easily moved back into the enclosure 10 after removal through the roll up door 22 to enable dumping of the tire fragments into a truck (not shown).

As seen in FIGS. 8A-10A and 8B-10B, the punches 60 may have a round shape 60A (FIGS. 8A, 8B) an oval shape 60B (FIGS. 9A, 9B) a rectangular/square shape 60C (FIGS. 10A, 10B), or any other desired shape.

The punches 60A, B, C each have a conically shaped end cavity forming a recessed center in 61A, B, C, in order to create a progressive cutting action which reduces the press tonnage required.

Accordingly, only minimal labor is needed to dispose of sets of used tires, and the process can be largely automated with the use of suitable automatic industrial controllers.

Also, the housing of the installation within the enclosure 10 allows the equipment and collected tire fragments to be located outside of the buildings of the retailer to be more easily accommodated.

FIGS. 11-16 show further details of some of the components described above.

In particular, FIGS. 11-14 show that the elevator mechanism platforms 32A-32D are interconnected with a set of three pairs of slotted bars 78A, 78B, 78C on each end thereof.

The platforms 32A-32D are slidable vertically on four guide bars 34 mounted in a framework 80.

The topmost platform 34D is able to be directly raised by movement of cable ends 82 attached to respective ends of the platform 34D and wound around a pulley assembly 84 driven by a motor-right angle drive unit 36 installed atop the framework 80.

A sequenced positioning of each platform 32A-32D aligned with the loading platform 40 is achieved by the interconnection established by the slotted bars 78A-C.

Figure 14:
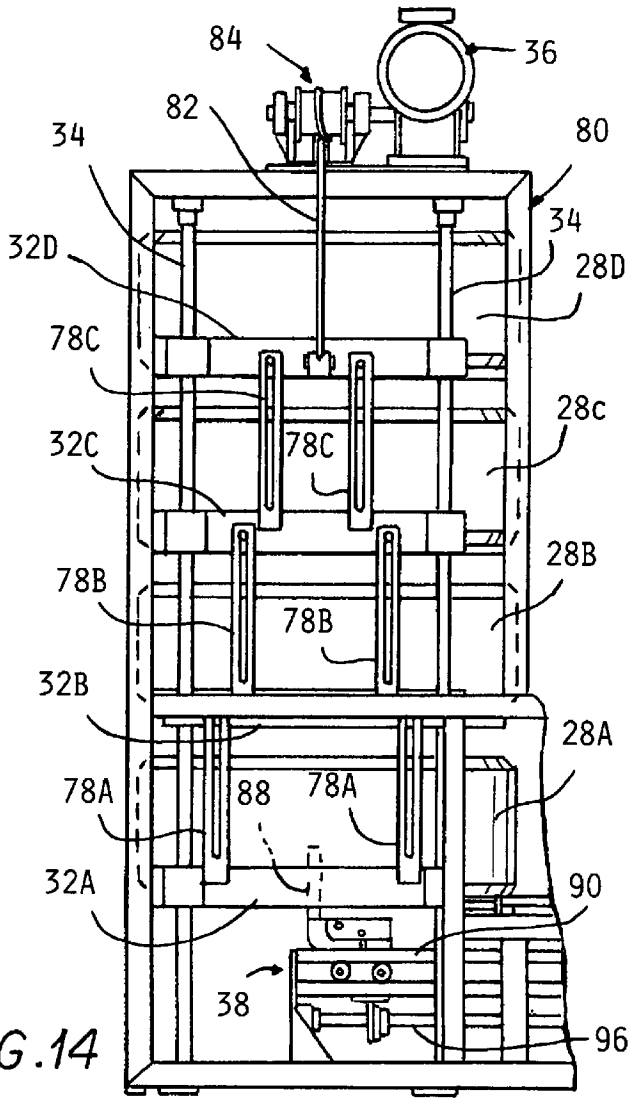
FIG. 14 is a right side view of the elevator mechanism shown fully loaded with four tires.

When the cable ends 82 are wound up, as seen in FIG. 14, the top platform 32D is suspended by the cable ends 82.

The next lower platform 32C hangs below on the slotted bars 78C, with platform 32B suspended therefrom on bars 78B, and the lowest platform 32A is suspended on slotted bars 78A.

In this position, the lowest platform 32A is aligned with transfer platform 40 such that the tire 28A can slid onto the platform 40 by the transfer device 38.

Upon unwinding of the cables 82, platform 32A is lowered below the loading platform 40 until the next lower platform 32B and tire 28B disposed thereon moves into registry with the loading platform 40.

Figure 13:
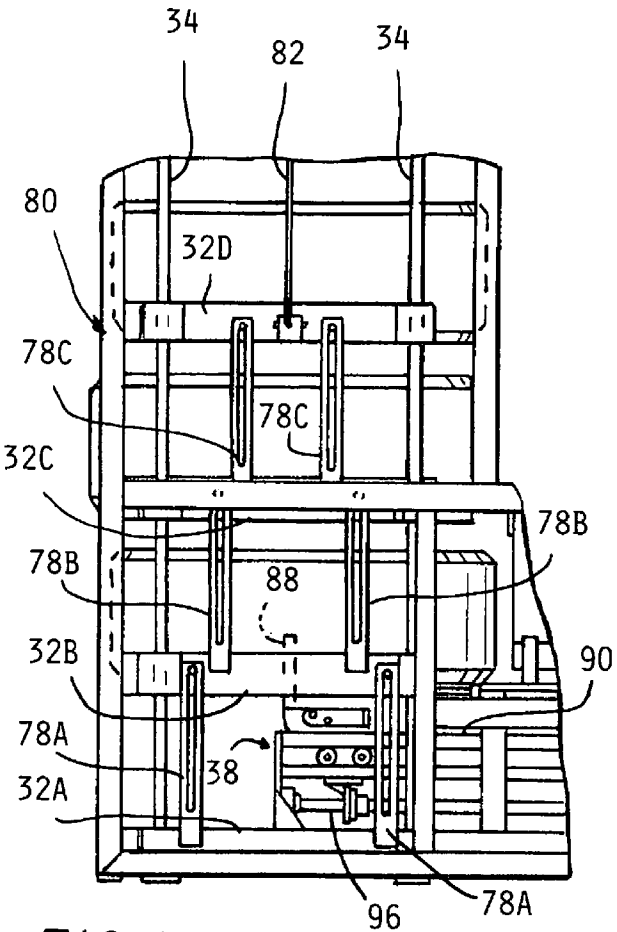
FIG. 13 is an enlarged fragmentary right side view of the elevator mechanism included in the tire chopping apparatus shown in FIG. 11 with three tires in the elevator mechanism.
Figure 15:
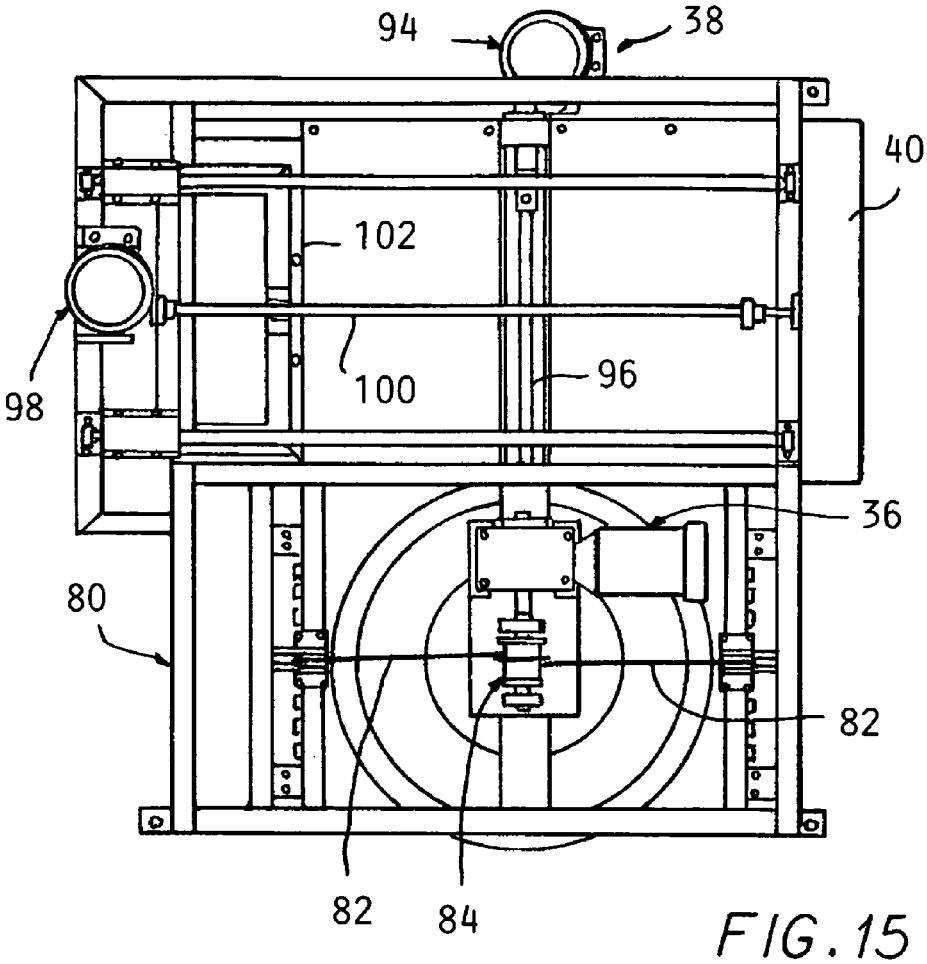
FIG. 15 is an overall plan view of the tire chopping apparatus.
Figure 16:
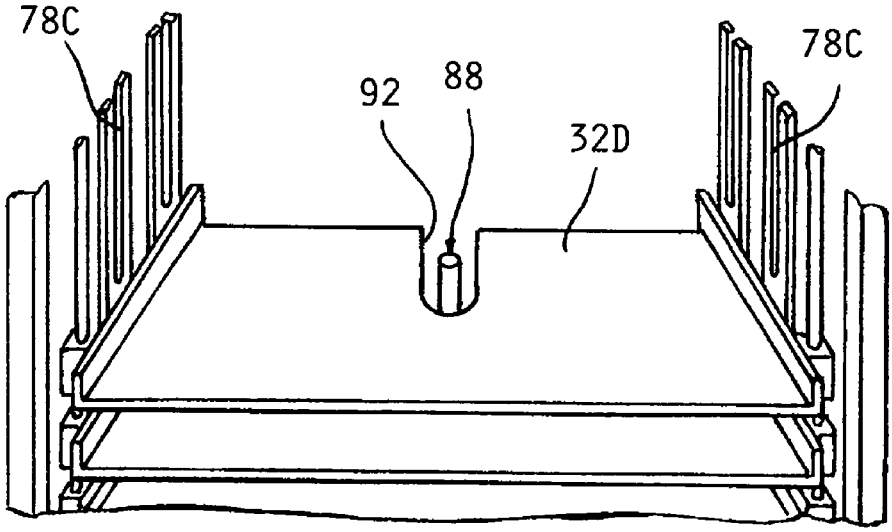
FIG. 16 is a pictorial partially broken away view of the elevator mechanism showing a slot which formed in each elevator mechanism platform to accommodate an engagement finger of a transfer mechanism.

After unloading of tire 28B, the platform 32B is moved down by further unwinding of the cable and comes to rest on the first platform 32A, the slots in the bars 78A allowing the second platform 32B to be moved down onto the first platform 32A (FIG. 13).

This repeats when platform 32C is lowered to the level of platform 40 (FIG. 11) with the bottom three platforms 32A-32C then stacked atop each other.

The transfer device 38 includes a hinged transfer finger 88 movable along a track 90 (FIGS. 12-16), with a slot 92 in each platform 32B-32D accommodating said finger 88 (FIGS. 12-16) during motion produced by motor-drive 94 and power screw 96. The finger 88 pulls each tire 28 onto platform 40 upon activation of the transfer motor-drive 94.

A feed drive motor 98 may be provided with a power screw 100 driving a pusher bar 102 to advance each tire 28A-28D incrementally into the punch press 50 as described above instead of with the hydraulic cylinder 44 described above.

The tire fragments may be further processed as by grinding as a further step in the reclaiming and/or disposal of the tire material.

The invention claimed is:

1. An apparatus for chopping up used tires comprising:

a press having upper and lower members with an array of closely spaced punches and mating dies mounted respectively on said upper and lower members said punches and dies arranged in staggered rows, each row of a length to sufficient substantially extend completely across major diameter of a tire lying flat on a working platform on said lower member;

a feed mechanism acting on said each tire to be incrementally linearly advanced between said rows of punches and dies to present successive sections extending completely across said tire lying flat beneath punch array; and a press actuator for repeatedly advancing said punch array so that said successive sections of said tire are advanced beneath said punches so as to cause said punches to penetrate successive sections extending completely across said tire lying flat to cause a progressive chopping up of said successive sections of said tire by punching through said sections of said tire extending completely across said tire thereof when lying flat to completely cut up said tire with said punches.

2. The apparatus according to claim 1 further including a conveyor collecting chopped up tire fragments produced in said press and conveying the same upwardly to an open top of a collection container into which said tire fragments are discharged by said conveyor.

3. The apparatus according to claim 2 wherein said press, conveyor, and collection container are housed within a common enclosure comprising a standard shipping container.

4. The apparatus according to claim 3 wherein a roll up door is provided in said enclosure adjacent said collection container enabling removal of said collection container.

5. The apparatus according to claim 1 further including an elevator mechanism having a plurality vertically spaced platforms each receiving a tire in a vertical stack and bringing each platform holding a tire in said stack successively to the level of a loading platform included in said feed mechanism, said platforms collapsible together as said platforms are brought to the level of said loading platform.

6. The apparatus according to claim 5 further including a transfer device moving each tire from a respective platform of said elevator mechanism onto said loading platform.

7. The apparatus according to claim 6 wherein said elevator mechanism platforms are interconnected with slotted bars allowing stacking up of said platforms on each other after continued lowering past said loading platform.

8. An installation for onsite disposal processing of used tires at a facility comprising:

an enclosure;

a punch press in said enclosure having an array of punches including installed therein for punching tires into fragments;

a feed mechanism in said enclosure for feeding each tire incrementally into said punch press array lying flat on a working platform located beneath said punch array so that said punch array completely extends across said tire lying flat beneath said punch array on said platform; said feed mechanism advancing said tire to align successive sections of said tire with said punch array;

a press control operating said punch press to successively penetrate each sections of said tire with punches in said array to completely chop up said tire into fragments; and a conveyor in said enclosure receiving said tire fragments and transporting said pieces into a collection container also located in said enclosure.

9. The installation according to claim 8 further including a door in said enclosure allowing access and removal of said collection container therethrough.

10. The installation according to claim 9 further including a feed mechanism for feeding a tire lying flat into said punch press.

11. The installation according to claim 10 further including an elevator mechanism for holding a stack of four tires and moving each of said four tires to a level of said feed mechanism for said punch press.

* * * * *